US007014507B1

(12) United States Patent
Kosmala

(10) Patent No.: US 7,014,507 B1
(45) Date of Patent: Mar. 21, 2006

(54) FILTERED CONNECTOR THAT BLOCKS HIGH FREQUENCY NOISE

(75) Inventor: Michael Lawrence Kosmala, Mission Viejo, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 152 days.

(21) Appl. No.: 10/932,951

(22) Filed: Sep. 1, 2004

(51) Int. Cl.
*H01R 13/66* (2006.01)

(52) U.S. Cl. ..... 439/620; 333/185

(58) Field of Classification Search ..... 439/620; 333/181–185
See application file for complete search history.

(56) References Cited

U.S. PATENT DOCUMENTS

| | | | | |
|---|---|---|---|---|
| 4,458,220 A | * | 7/1984 | Carter et al. | 439/620 |
| 4,494,092 A | | 1/1985 | Griffin | 333/182 |
| 4,729,743 A | * | 3/1988 | Farrar et al. | 439/620 |
| 4,729,752 A | | 3/1988 | Dawson, Jr. et al. | 439/620 |
| 4,781,624 A | | 11/1988 | Shepherd | 439/620 |
| 4,820,202 A | | 4/1989 | Edwards et al. | 439/620 |
| 4,853,659 A | | 8/1989 | Kling | 333/184 |
| 4,867,706 A | | 9/1989 | Tang | 439/620 |
| 5,236,376 A | | 8/1993 | Cohen | 439/620 |
| 5,580,279 A | | 12/1996 | Belopolsky et al. | 439/620 |
| 5,605,477 A | | 2/1997 | Wu et al. | 439/620 |
| 5,626,494 A | | 5/1997 | Belopolsky et al. | 439/620 |
| 5,639,264 A | | 6/1997 | Belopolsky et al. | 439/620 |
| 5,769,667 A | | 6/1998 | Belopolsky | 439/620 |
| 5,803,769 A | | 9/1998 | Belopolsky | 439/620 |
| 5,816,857 A | | 10/1998 | Belopolsky | 439/620 |
| 5,823,827 A | | 10/1998 | Belopolsky | 439/620 |
| 5,838,216 A | | 11/1998 | White et al. | 333/182 |
| 6,508,672 B1 | | 1/2003 | Safai | 439/620 |
| 6,896,552 B1 | * | 5/2005 | Kosmala | 439/620 |
| 2001/0009816 A1 | * | 7/2001 | Durr et al. | 439/620 |

* cited by examiner

*Primary Examiner*—Tho D. Ta
(74) *Attorney, Agent, or Firm*—Peter Van Winkle

(57) ABSTRACT

A filtered connector is provided of the type that includes an inductor (40) and capacitors (51, 52) connected in a pi filter arrangement to each contact (20) of the connector to attenuate high frequency noise, is enhanced to better block very high frequency noise. Each of applicant's filters that are connected to a contact have at least two capacitors (51, 53 and 52, 54) on either side of the inductor, the two capacitors being connected to contact locations that are spaced apart.

8 Claims, 3 Drawing Sheets

FIG.2
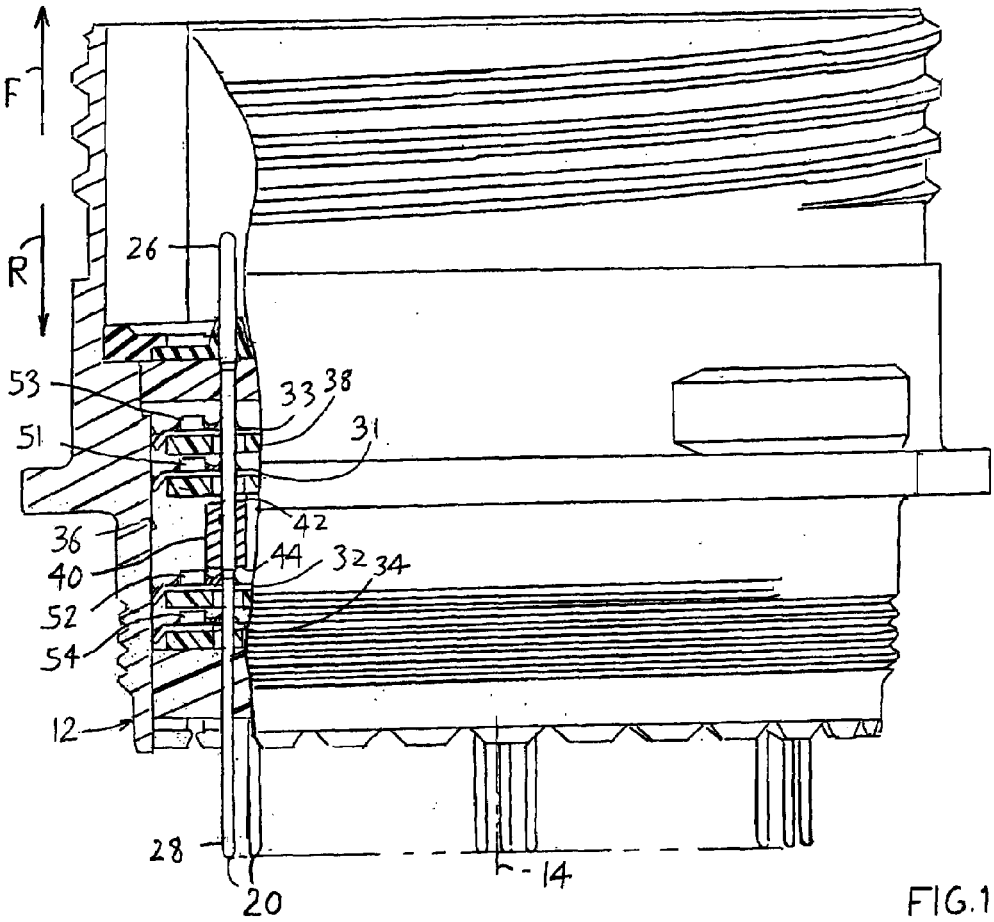
FIG.1
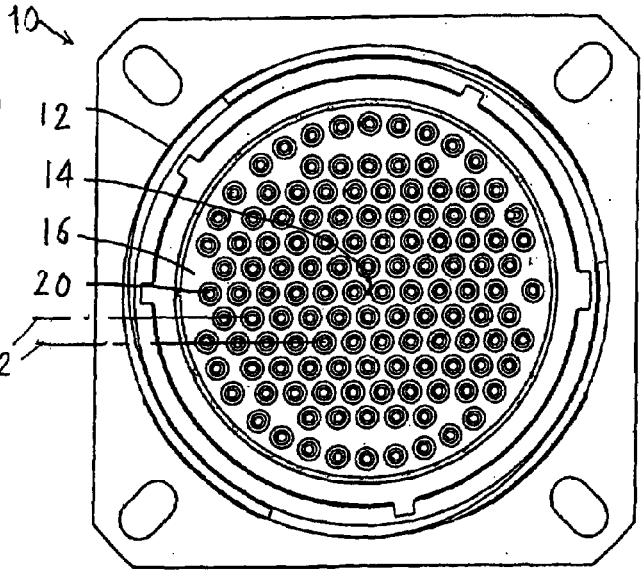
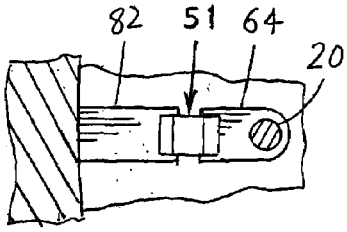
FIG. 3

ATTENUATION

102
EXTENDED PI
-67dB
104
PI
-42dB
FREQ
100MHZ
1GHz

ATTEN

EXTENDED PI
112
114
PI WITH
LARGE CAPACITANCE
100 MHZ
1GHz

FILTERED CONNECTOR THAT BLOCKS HIGH FREQUENCY NOISE

BACKGROUND OF THE INVENTION

One type of filtered connector includes a plurality of pin-like contacts that project through holes in an insulator and though inductors in the form of ferrite beads. A pair of capacitors, which may be mounted on boards lying beyond opposite ends of the ferrite beads, are connected to corresponding contact locations. This arrangement, commonly referred to as a pi filter, is useful to block high frequency noise, such as noise of a frequency above one MHz. The attenuation of noise can be increased at lower frequencies by the use of a larger inductor and larger capacitors, but there are restrictions in the space available in filter connectors. For example, the filtered connector illustrated in the drawings has 128 contacts arranged in multiple rows, in a connector shell having a length of about 1.5 inch and an outer shell diameter of about 1.6 inch. The contacts in the shell are spaced apart (center-to-center) by 0.100 inch along each row. In a prior art connector of these dimensions, using a pi filter with two capacitors each of 5000 picofarads and a ferrite bead having a bead diameter of 0.065 inch and length of 0.125 inch, applicant achieved an attenuation of −42 dB at a frequency of 1 GHz. A significantly higher attenuation using filter elements that fit into the same connector shell, would be of value.

SUMMARY OF THE INVENTION

In accordance with one embodiment of the invention, a filtered connector is provided which includes filter components that fit into a small space and that provide increased attenuation of high frequency noise. The connector is of the type that includes a prior art pi filter for each connector contact, the pi filter including a ferrite bead inductor threaded onto the contact and first and second capacitors. In such pi filters, the capacitors are connected to the contact at first and second locations that lie beyond opposite ends of the bead. However, applicant greatly increases very high frequency noise attenuation by the use of third and fourth capacitors that lie beyond opposite ends of the ferrite bead. The third and fourth capacitors are connected to the contact at locations that are spaced from the first and second locations where the first and second capacitors are connected to the contact, to provide an extended pi filter.

The third and fourth locations along the contact where the third and fourth capacitors are connected to the contact, are spaced from the first and second locations by controlled distances. The spacing distances (center-to-center distances) are each a plurality of thousandths inch, preferably at least twenty thousandths inch.

The novel features of the invention are set forth with particularity in the appended claims. The invention will be best understood from the following description when read in conjunction with the accompanying drawings.

BRIEF DESCRIPTION OF THE DRAWINGS

FIG. 1 is an end view of a filtered connector of the present invention.

FIG. 2 is a partially section side elevation view of the connector of FIG. 1.

FIG. 3 is a view taken on line 3—3 of FIG. 4, showing a portion of one of the boards of the connector.

DESCRIPTION OF THE PREFERRED EMBODIMENT

Figure 4:
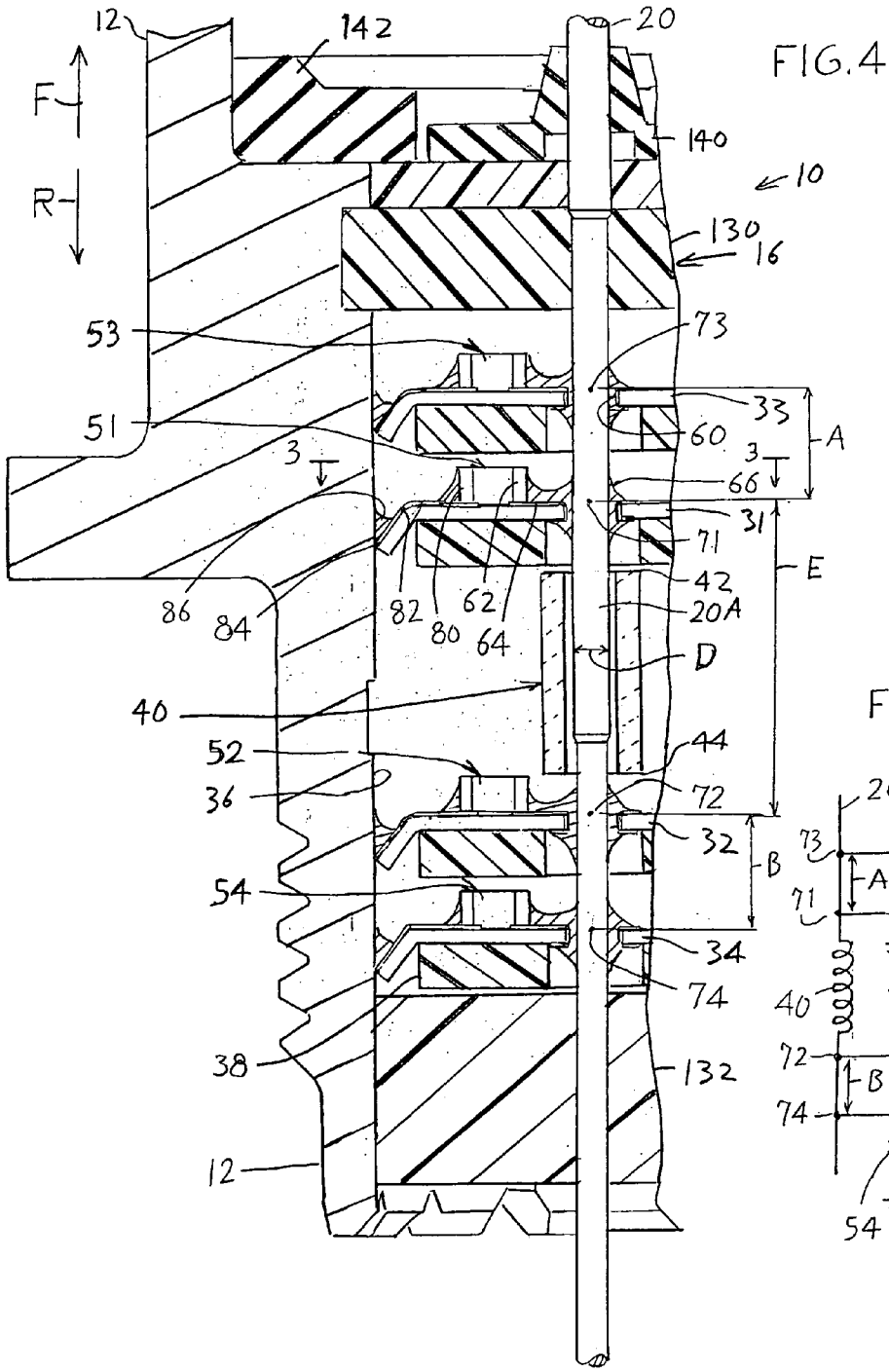
FIG. 4 is an enlarged sectional view of a portion of the connector of FIG. 2.

FIG. 1, shows a connector 10 of the invention which includes a metal shell 12 having an axis 14, an insulator 16 within the shell, and a plurality of elongated contacts 20 that extend through holes in the insulator. The particular connector includes 128 contacts arranged in multiple rows 22 and lying within a shell having an outside diameter of about 1.6 inches. The contacts are designed to carry low frequencies (DC to about one MHz), and the connector includes a filter for each contact that blocks high frequency noise, which is here generally defined as noise having a frequency above one MHz.

FIG. 2 shows that the connector has a construction similar to that described in U.S. patent application Ser. No. 10/430,933 filed May 6, 2003. U.S. Pat. No. 6,896,552 That is, the connector includes multiple elongated contacts 20 with opposite ends 26, 28 spaced in front F and rear R directions and that are accessible from opposite ends of the connector. As also shown in FIG. 4, a plurality of flexible circuit boards 31, 32, 33, and 34 extend across a cavity 36 formed in the shell 12, in planes that are normal to the connector axis 14. A rigidizing board 38 lies below portions of each circuit board. An inductor in the form of a ferrite bead 40 with front and rear ends 42, 44, is threaded around each contact. Two of the boards 31, 33 lie forward of the bead, while two of the boards 32, 34 lie rearward of the bead. The boards carry capacitors 51, 52, 53, and 54 that are connected to the contact. The ferrite beads and capacitors provide filtering that blocks high frequency noise from passing along the contact. Many of the contacts of the connector are similarly filtered, with all of the contacts of the particular connector 10 being similarly filtered by providing a separate ferrite bead and set of capacitors for each contact.

FIG. 4 shows that each board has a hole 60 through which the contact 20 extends. Each capacitor such as 51, has a pair of terminals, with one terminal 62 connected to a signal trace 64 on the circuit board that extends to, and preferably completely around the hole in the board. The signal trace is connected by a solder joint 66 to a location 71 on the contact. The other capacitor terminal 80 connects to a ground trace 82 that is electrically grounded. FIG. 4 shows that the ground trace extends to a periphery 84 of the board where the board is bent and soldered by a solder joint 86 to the metal shell.

Figure 5:
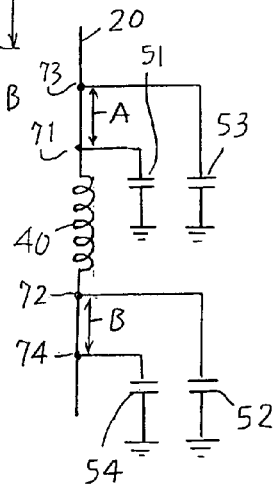
FIG. 5 is a schematic diagram showing the electrical characteristics of one of the contacts and associated filter elements of the connector of FIG. 4.

Previously, only the first and second capacitors 51, 52 were connected to the contact, at locations 71, 72, with one location 71 lying forward of the ferrite bead 40 and the other 72 lying rearward of the bead, to create a pi filter. In accordance with the present invention, applicant provides third and fourth capacitors 53, 54 that connect to contact connect locations 73, 74. One of the additional locations 73 where the third capacitor 53 connects to the contact, lies forward of the ferrite bead 40 and is spaced a distance A from the first location 71. The other additional location 74, where the fourth capacitor 54 connects to the contact, lies rearward of the ferrite bead and is spaced a distance B from the second location 72. Applicant calls the combination of a pi filter and at least two additional capacitors 53, 54, with an additional capacitor connected to a contact location lying beyond each end of the ferrite bead, an extended pi filter. FIG. 5 is a schematic diagram of the contact 20 and of the ferrite bead and capacitors.

Figure 6:
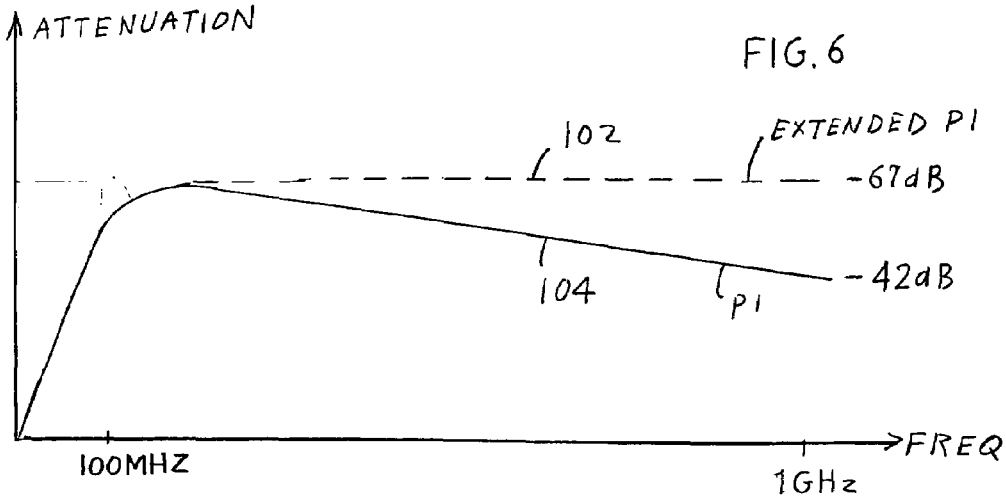
FIG. 6 is a graph showing change in noise attenuation with frequency, for a prior pi filter and for applicant's extended pi filter, that use the same total capacitance.

FIG. 6 is a graph that qualitatively shows the advantage of applicant's extended pi filter over a prior pi filter. Below a frequency of about 100 MHz, the filter characteristics are similar. However, considerably above 100 MHz, such as above 500 MHz, applicant's extended pi filter, whose performance is given by graph line 102, is better at attenuating very high frequency noise. Tests conducted by applicant show that at 1 GHz, the prior pi filter (with two 5000 picofarad capacitors), whose performance is given by graph line 104, produces an attenuation of −42 dB, while applicant's extended pi filter (with four 2500 picofarad capacitors) produces an attenuation of −67 dB. Also, applicant's extended pi filter has an attenuation that does not significantly decrease with increasing frequency near 1 GHZ.

Figure 7:
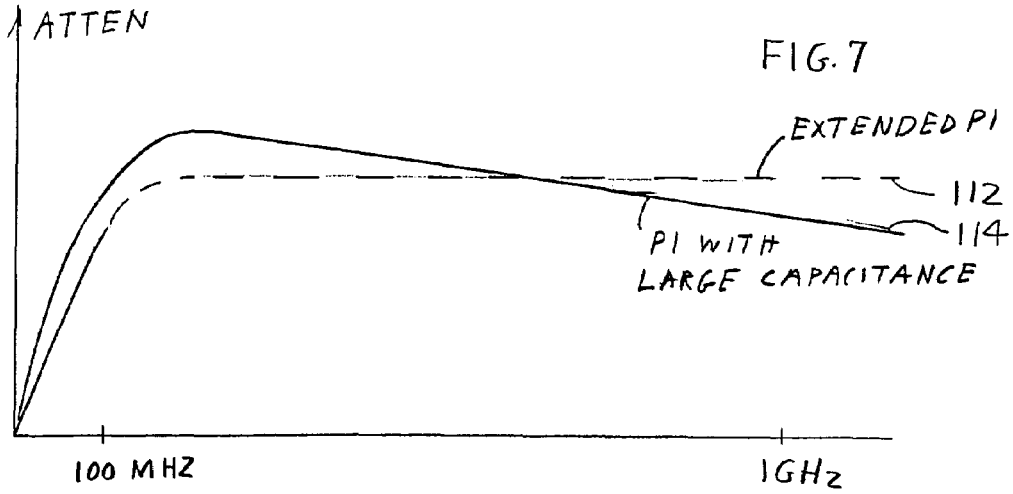
FIG. 7 is a graph showing change in noise attenuation with frequency, for a prior pi filter and for applicant's extended pi filter, where the prior pi filter uses a larger total capacitance than applicant's extended pi filter.

FIG. 7 shows the effects of increasing the capacitance (to a plurality of times 5000 picofarads) of the two capacitors of a prior art pi filter, as compared to applicant's extended pi filter (with 4 capacitors of 2500 picofarads each and with an inductor having an inductance of 100 microneries). Graph line 112 shows the performance of applicant's extended pi filter, while graph line 114 shows the performance of a prior pi filter with increased capacitance (two capacitors, each with a capacitance of a plurality of times 5000 picofarads). It can be seen that the effect of the high capacitance in a prior pi filter is to obtain greater attenuation of noise at lower frequencies such as below about 500 MHz, while reducing attenuation of noise with increasing frequency more rapidly than in applicant's extended pi filter.

FIG. 4 shows that the contact pin portion 20A that extends through the ferrite bead 40 has a diameter D of 0.020 inch (0.5 millimeter). The first and second locations 71, 72 where the first and second capacitors connect to the contact are spaced apart by a distance E of about 0.200 inch (5 mm). The distance A between the first contact connect location 71 and the third location 73, is 0.060 inch (1.5 mm). Similarly, the distance B between the second and fourth contact connect locations is 0.060 inch (1.5 mm). Applicant tested the attenuation characteristics at both 0.040 inch and 0.060 inch separations and found that better attenuation was achieved at 0.060 inch separations. The separation should not exceed about 0.5 inch.

The connector of FIG. 4 can be assembled by positioning, in a fixture, a pair of insulator plates 130, 132 of the insulator 16, the four flexible circuit boards 31–34 with capacitors thereon, and the ferrite beads, all with their contact-receiving holes aligned. The contacts 20 are then inserted rearwardly though the holes, and the shell 12 is slid over the peripheries of the boards 31–34. The assembly is soldered to form the solder joints, and other parts such as elastomeric seals 140, 142 are put in place.

The center-to-center spacings A and B between capacitors that both lie beyond the same end of the ferrite bead, should be a plurality of thousandths inch in any case, and preferably on the order of magnitude of 1.5 mm (0.060 inch). Applicant achieves an improvement in attenuation when the spacing A, B is at least equal to one half the diameter D of the contact portion that passes though the bead and capacitors, and especially when the spacing is at least equal to the contact diameter. Such spacing is preferably at least 1.5 millimeter (0.020 inch). As mentioned above, applicant has used spacings A, B of about 1.5 mm (1 to 2 millimeters) for best results while providing a filter arrangement that still fits into the connector of predetermined size.

Thus, the invention provides an extended pi filter for attenuating high frequency noise such as noise of at least one MHz, and especially noise above 100 or 500 MHz frequency, such as at 1 GHz, and that is especially useful in a connector of limited size where there is limited room available for filter components. The connector includes a pi filter connected to a contact, wherein the pi filter is modified by adding at least one capacitor beyond each end of the inductor. Two capacitors lying beyond each end of a ferrite bead inductor, are connected to a contact at connect locations that are spaced apart along the length of the contact. The center-to-center spacing of the contact connect locations are a plurality of thousandths inch, preferably at least 0.020 inch (0.5 mm) but no more than about 0.5 inch, and preferably on the order of magnitude of 1.5 mm (0.06 inch).

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A filter connector that includes a plurality of elongated contacts, a plurality of ferrite beads each extending around one of said contacts with each bead having front and rear ends, and first and second pluralities of capacitors that each has a signal terminal and a grounded ground terminal, the signal terminal of each of said first capacitors being connected to one of said contacts at a first location that lies forward of the front end of the corresponding bead and the signal terminal of each of said second capacitors being connected to one of said contacts at a second location that is rearward of the rear end of the corresponding bead, including:

third and fourth pluralities of capacitors that each have grounded terminals, said third capacitors each having a signal terminal connected to one of said contacts at a third location that lies forward of the front end of the corresponding bead, and that is spaced from the corresponding first location;

said fourth capacitors each having a signal terminal connected to one of said contacts at a fourth location that lies rearward of the rear end of the corresponding bead and that is spaced from the corresponding second location.

2. The connector described in claim 1 wherein:

said first and third locations along a contact where corresponding ones of said first and third capacitors connect to the corresponding contact, are spaced apart by a plurality of thousandths of an inch;

said second and fourth locations along a contact where corresponding ones of said second and fourth capacitors connect to the corresponding contact are spaced apart by a plurality of thousandths of an inch.

3. The connector described in claim 1 wherein:

said capacitors each have a capacitance on the order of magnitude of 2500 picofarads, said first and third locations are spaced apart by a distance on the order of magnitude of 1.5 millimeters, and said second and fourth locations are spaced apart by a distance on the order of magnitude of 1.5 millimeters.

4. The connector described in claim 1 wherein:

said connector includes a metal shell with an axis and at least four circuit boards extending perpendicular to said axis and spaced apart along said axis;

each circuit board having a plurality of holes through which said contacts extend, and each circuit board having a plurality of signal traces extending around one of said holes and soldered to a contact thereat, each capacitor signal terminal being connected to one of said signal traces;

said circuit boards are arranged with first and third boards spaced from each other by at least 0.02 inch and with said first and third boards both lying forward of said beads, and said circuit boards are arranged with second and fourth boards spaced from each other by at least 0.02 inch and with said second and fourth boards both lying rearward of said beads.

5. A filtered connector which includes first and second boards lying in spaced parallel planes and having multiple pairs of aligned holes, each board having a plurality of signal traces that each extends to one of the board holes and each board having a plurality of ground traces, the connector including a plurality of elongated contacts that each extends through holes in a pair of said boards with each contact connected to the signal traces at the holes, a plurality of ferrite beads each having opposite front and rear ends and each surrounding one of said contacts and lying between said first and second boards with said first board lying forward of said beads and said second board lying rearward of said beads, and said connector includes first and second sets of capacitors lying respectively on said first and second boards with each capacitors having one terminal connected to one of said signal traces and another terminal connected to one of said ground traces, including:

third and fourth boards, each having a plurality of holes aligned with said holes of said first and second boards and each of said third and fourth boards having signal traces extending to said holes and connected to said contacts thereat and having ground traces, said third board lying forward of said first board and said fourth board lying rearward of said second board;

third and fourth sets of capacitors lying respectively on said third and fourth boards, each of said third and fourth sets of capacitors having one terminal connected to one of said signal traces on its corresponding board and another terminal connected to one of said ground traces on its corresponding board.

6. The connector described in claim 5 wherein:

the spacing between said first and second boards is greater than the spacing between said first and third boards, and is greater than the spacing between said second and fourth boards.

7. The connector described in claim 5 wherein:

the spacing between said first and third boards, and the spacing between said second and fourth boards, is each on the order of magnitude of 1.5 millimeters.

8. The connector described in claim 5 wherein:

said capacitors of said first, second, third and fourth sets each have a capacitance on the order of magnitude of 2500 picofarads, the spacing of said first and third boards is about 1.5 mm, and the spacing of said second and fourth boards is about 1.5 mm.

* * * * *